US005197646A

United States Patent [19]

Nikolich

[11] Patent Number: 5,197,646

[45] Date of Patent: Mar. 30, 1993

[54] COMBUSTION-POWERED TOOL ASSEMBLY

[75] Inventor: Milovan A. Nikolich, Wilmette, Ill.

[73] Assignee: Illinois Tool Works Inc., Glenview, Ill.

[21] Appl. No.: 848,277

[22] Filed: Mar. 9, 1992

[51] Int. Cl.[5] ..... B25C 1/08

[52] U.S. Cl. ..... 227/8; 227/10; 123/46 SC

[58] Field of Search ..... 227/8, 9, 10; 123/46 SC

[56] References Cited

U.S. PATENT DOCUMENTS

| | | | |
|---|---|---|---|
| 4,403,722 | 9/1983 | Nicolich | 227/8 |
| 4,405,071 | 9/1983 | Austin | 227/8 X |
| 4,483,473 | 11/1984 | Wagdy | 227/8 |
| 4,483,474 | 11/1984 | Nicolich | 227/8 |
| 4,721,240 | 1/1988 | Cotta | 227/9 X |
| 5,090,606 | 2/1992 | Torii et al. | 227/8 X |

*Primary Examiner*—Frank T. Yost
*Assistant Examiner*—Rinaldi Rada
*Attorney, Agent, or Firm*—Schwartz & Weinrieb

[57] ABSTRACT

In a combustion-powered, fastener-driving tool, a cylinder body mounted fixedly within a housing structure has a combustion chamber defining an axis. A valve sleeve functions to open and close the combustion chamber. A piston operative within the combustion chamber and a driving blade moveable with the piston function to drive a fastener into a workpiece. An improved linkage for moving the valve sleeve includes a workpiece-contacting element and a pair of arms attached to such element and disposed alongside the cylinder body and the nosepiece. An improved, one-piece, interlocking member prevents a trigger from being actuated unless the combustion chamber is closed. Thus, a simple, compact, lightweight tool is provided.

17 Claims, 6 Drawing Sheets 10
12
14
16
20
30
32
34
36
40
42
50
52
54
60
62
64
66
68
70
72
74
76
78
80
82
84
86
88
90
92
94
120
122
124
126
130
131
132
134
136
140
142
144
150
152
154
156
158
160
N
W 10
12
14
60
74
160
72
70
64
68
66
144
124
40
142
38
132
62
30
140
126
32
42
130
122
120
76
78
34
54
90
90
80
20
50
52
82

Fig. 8
PRIOR ART
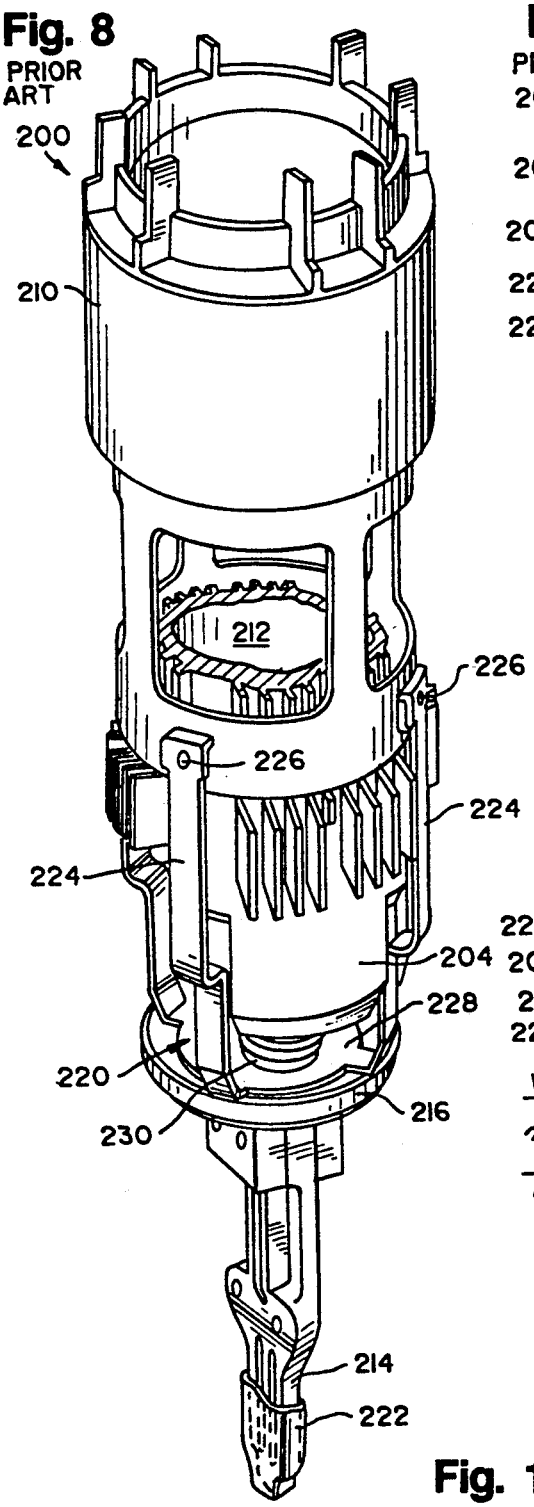
Fig. 9
PRIOR ART
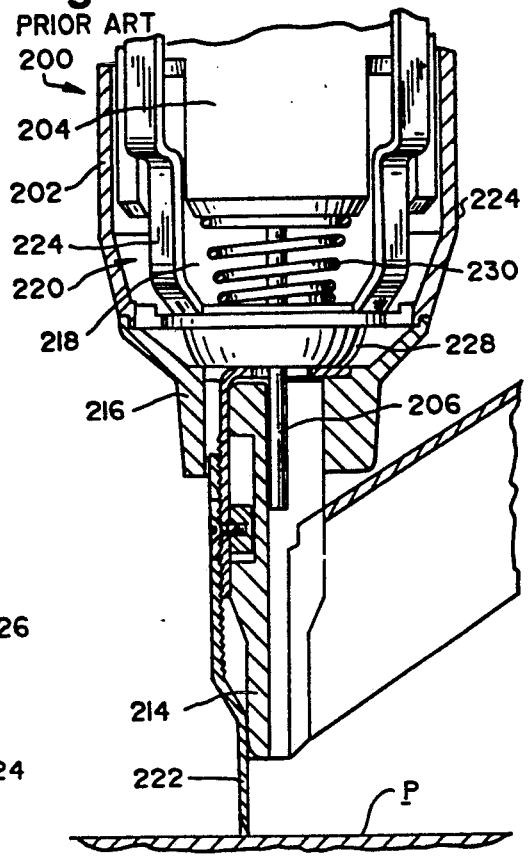
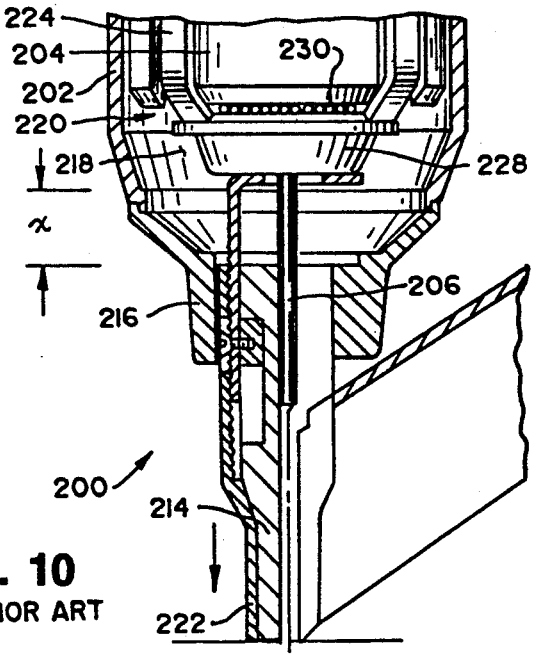
Fig. 10
PRIOR ART

COMBUSTION-POWERED TOOL ASSEMBLY

FIELD OF THE INVENTION

This invention provides improvements in a combustion-powered tool for driving fasteners, such as nails or staples. First, an improved linkage is provided for moving a valve member. The improved linkage includes a workpiece-contacting element and a pair of arms disposed alongside a cylinder body and interconnected by an element disposed along a nosepiece.

Second, an improved, one-piece interlocking member is provided, which is useful to prevent actuation of a trigger unless the valve member has been moved to a position wherein a combustion chamber is closed.

BACKGROUND OF THE INVENTION

Typically, as exemplified in Nikolich U.S. Pat. Re. 32,452, Nikolich U.S. Pat. No. 4,522,162, Nikolich U.S. Pat. No. 4,483,474, Nikolich U.S. Pat. No. 4,403,722, and Wagdy U.S. Pat. No. 4,483,473, a combustion-powered, fastener-driving tool comprises a combustion chamber, which is defined by a cylinder body and by a valve sleeve arranged for opening and closing the combustion chamber. Generally similar, combustion-powered, nail- and staple-driving tools are available commercially from ITW-Paslode (a unit of Illinois Tool Works Inc.) of Lincolnshire, Ill., under its IMPULSE trademark.

Typically, in such a tool, a housing structure encloses a cylinder body, which defines a tool axis, and within which a piston is mounted operatively. A valve sleeve is mounted in movable relation to the cylinder body so as to open and close a combustion chamber defined by the cylinder body and the valve sleeve. A nosepiece is mounted to the housing structure, in axially spaced relation to the cylinder body, via a separate piece defining a lower chamber between the cylinder body and the nosepiece.

A linkage is used to close the combustion chamber when an element of the linkage contacts a workpiece. Plural arms of the linkage are connected to the valve sleeve by fasteners and are connected to the workpiece-contacting element by an intermediate element disposed within the lower chamber and across the tool axis. The linkage arms extend outwardly from the lower chamber, through outer apertures, and upwardly along the cylinder body. The lower chamber provides axial clearance, e.g. about one inch of axial clearance, to permit axial movement of the arms and intermediate element of the linkage relative to the cylinder body, the nosepiece, and the housing structure.

This invention has resulted from efforts to redesign such a tool so as to reduce its axial length and its overall weight. Even small reductions in the length and weight of such a tool can meaningfully increase its versatility.

SUMMARY OF THE INVENTION

According to a first aspect of this invention, this invention contemplates an improvement providing a simple, compact, lightweight, combustion-powered tool for driving fasteners.

Thus, in one contemplated form, the tool includes a cylinder body, a nosepiece, and a valve sleeve. The cylinder body has a gas inlet and outlet passage and defines a longitudinal axis of the tool. The nosepiece extends axially from the cylinder body. The valve sleeve is mounted movably around the cylinder body for opening and closing the passage.

When embodied in a tool of the aforenoted form, the improvement comprises a valve sleeve-actuating linkage, which has a pair of arms disposed alongside the cylinder body and interconnected by an element disposed alongside the nosepiece. The arms provide operative connections to the valve sleeve. There is no need for a lower chamber to provide axial clearance for any part of the valve sleeve-actuating linkage. Therefore, as compared to combustion-powered tools known heretofore, the axial length of the tool and its overall weight can be meaningfully reduced.

According to a second aspect of this invention, a one-piece interlocking member is connected between a trigger and a valve member, such as the valve sleeve noted above, so as to prevent actuation of the trigger unless the valve member has been moved to a position wherein the valve member closes a combustion chamber of the combustion-powered tool.

BRIEF DESCRIPTION OF THE DRAWINGS

These and other objects, features, and advantages of this invention are evident from the following description of a preferred embodiment of this invention with reference to the accompanying drawings, in which like reference characters designate like or corresponding parts throughout the several views, and wherein:

FIG. 1 shows the tool with a workpiece-contacting member pressed against a workpiece, with a trigger actuated, and with a piston in an upper position.

FIG. 2 is a fragmentary, cross-sectional view taken along a vertical plane normal to the vertical plane along which FIG. 1 is taken. The piston is shown in a lower position.

FIG. 8 is a perspective view of a cylinder body, a valve sleeve, a nosepiece, a workpiece-contacting member, and related components of a combustion-powered tool exemplifying the prior art.

FIG. 9 is a fragmentary, cross-sectional view of some of the tool components of FIG. 8 with the workpiece-contacting member extended. A housing structure is shown fragmentarily.

FIG. 10 is a similar view of the components shown in FIG. 9 with the workpiece-contacting member pressed against a workpiece.

BRIEF DESCRIPTION OF PRIOR ART TOOL

Figure 1:
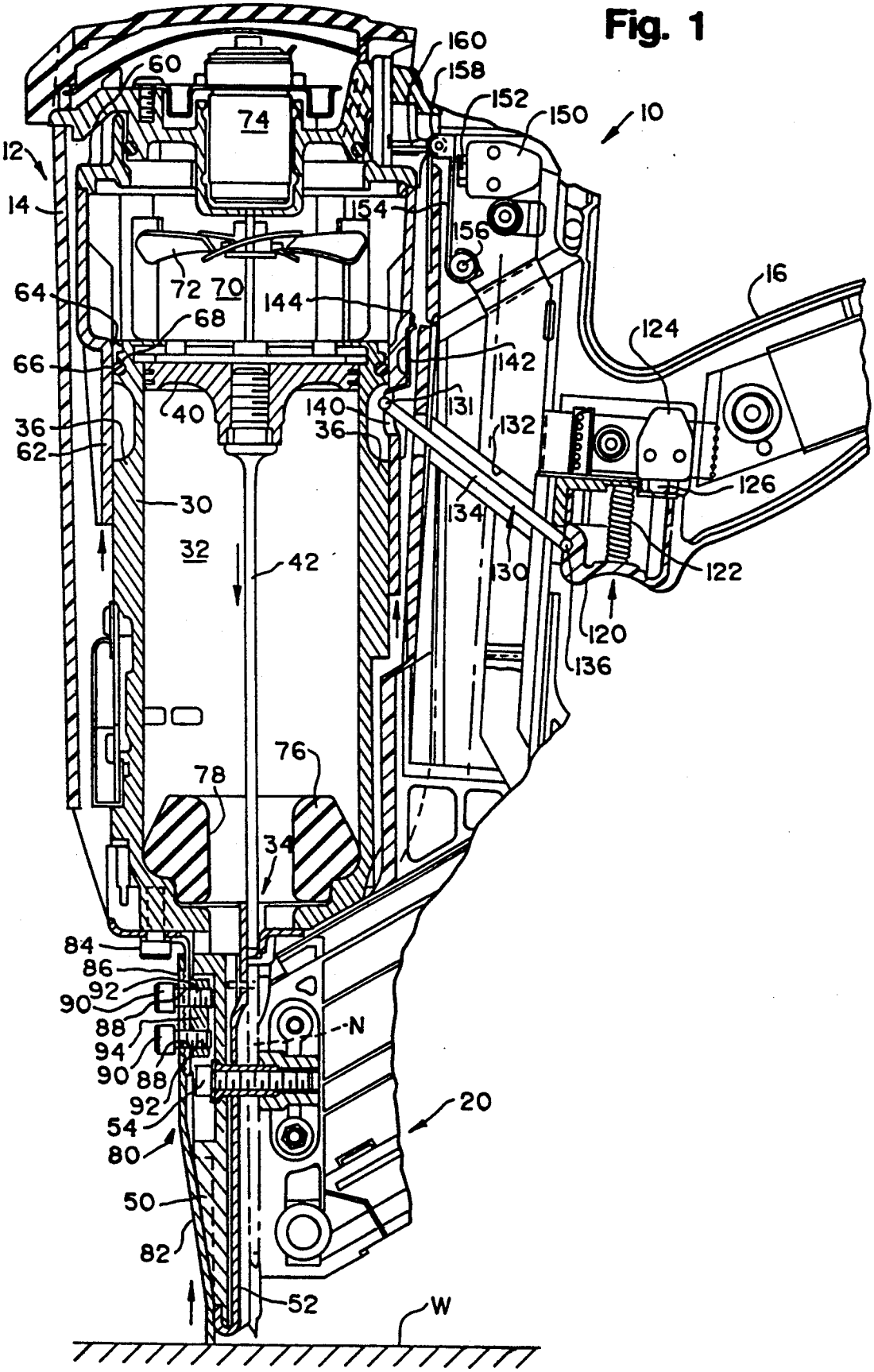
FIG. 1 is a fragmentary, cross-sectional view taken along a vertical plane through a combustion-powered, nail-driving tool constituting a preferred embodiment of this invention.

Before a detailed description is given of a combustion-powered tool embodying this invention, a brief description follows of a combustion-powered, fastener-driving tool 200 illustrated in FIGS. 8, 9, and 10 and exemplifying the prior art. The tool 200 is similar to combustion-powered, fastener-driving tools exemplified in the Nikolich patents identified above and to combustion-powered, fastener-driving tools available commercially from ITW-Paslode (a unit of Illinois Tool Works Inc.) of Lincolnshire, Ill., under its IMPULSE trademark.

The tool 200 comprises a housing structure 202 (see FIGS. 9 and 10) within which a cylinder body 204 is mounted fixedly. The cylinder body 204 defines a tool axis. A piston (not shown) is mounted operatively in the cylinder body 204. The piston is arranged to drive a driving blade 206 extending axially from the cylinder body 204. A valve sleeve 210 is mounted in axially movable relation to the cylinder body 204. The cylinder body 204 and the valve sleeve 210 define a combustion chamber 212. The valve sleeve 210 is moveable axially, along the cylinder body 204, so as to open and close the combustion chamber 212. A nosepiece 214 is mounted to the housing structure 202, in axially spaced relation to the cylinder body 204, via a separate piece 216 defining a lower chamber 218 between the cylinder body 204 and the nosepiece 214.

A linkage 220, which includes a workpiece-contacting element 222, is used to close the combustion chamber 212 when the element 222 contacts a workpiece P. The linkage 220 includes four arms 224 connected to the valve sleeve 210 by fasteners 226. The linkage arms 224 are connected to each other and to the workpiece-contacting element 222 by an intermediate structure 228 disposed within the lower chamber 218 and across the tool axis. The linkage arms 224 are shaped so as to extend outwardly from the lower chamber 218 and upwardly along the cylinder body 204. A coiled spring 230 is disposed within the lower chamber 218, between the cylinder body 204 and the intermediate structure 228, so as to bias the valve sleeve, via the linkage 220, to a position wherein the combustion chamber 212 is opened.

The lower chamber 218 provides axial clearance, e.g. about one inch of axial clearance, to permit axial movement of the linkage arms 224 and the intermediate structure 228 relative to the cylinder body 204, the nosepiece 214, and the housing structure 202.

This invention eliminates the lower chamber pervading axial clearance for the coiled spring and the elements connecting the workpiece-contacting element to the valve sleeve. Consequently, this invention provides a simple, compact, lightweight tool.

DETAILED DESCRIPTION OF PREFERRED EMBODIMENT

As shown in FIGS. 1 through 4, a combustion-powered, nail-driving tool 10 constitutes a preferred embodiment of this invention. Because of the improvements provided by this invention, the tool 10 is simple, compact, and lightweight.

Except as illustrated and described herein, the tool 10 may be substantially similar in its structure and functions to prior combustion-powered tools disclosed in the Nikolich patents noted above, the disclosures of which are incorporated herein by reference. Herein, directional terms including "upper", "lower", and terms of similar import are used to refer to the tool 10 in a convenient orientation, in which the tool 10 is shown in the drawings. It should be understood that this invention is not limited to any particular orientation.

The tool 10 includes a generally hollow housing structure 12 molded from a suitable engineering polymer. The housing structure 12 has a principal portion 14 and a handle portion 16. THe housing structure 12 mounts a nail-feeding mechanism 20 shown fragmentarily. The nail-feeding mechanism 20 is used to feed nails N (one shown in FIG. 1) successively into the tool 10. A shown in FIG. 1, the nail N is a known nail having an elongate, pointed shank and an offset or clipped head. Preferably, the nail-feeding mechanism 20 conforms to the nail-feeding mechanism disclosed in a copending application assigned commonly herewith and filed Oct. 21, 1991, under U.S. Ser. No. 07/779,892, for FASTENER-DRIVING TOOL WITH IMPROVED FEEDING MECHANISM.

Figure 3:
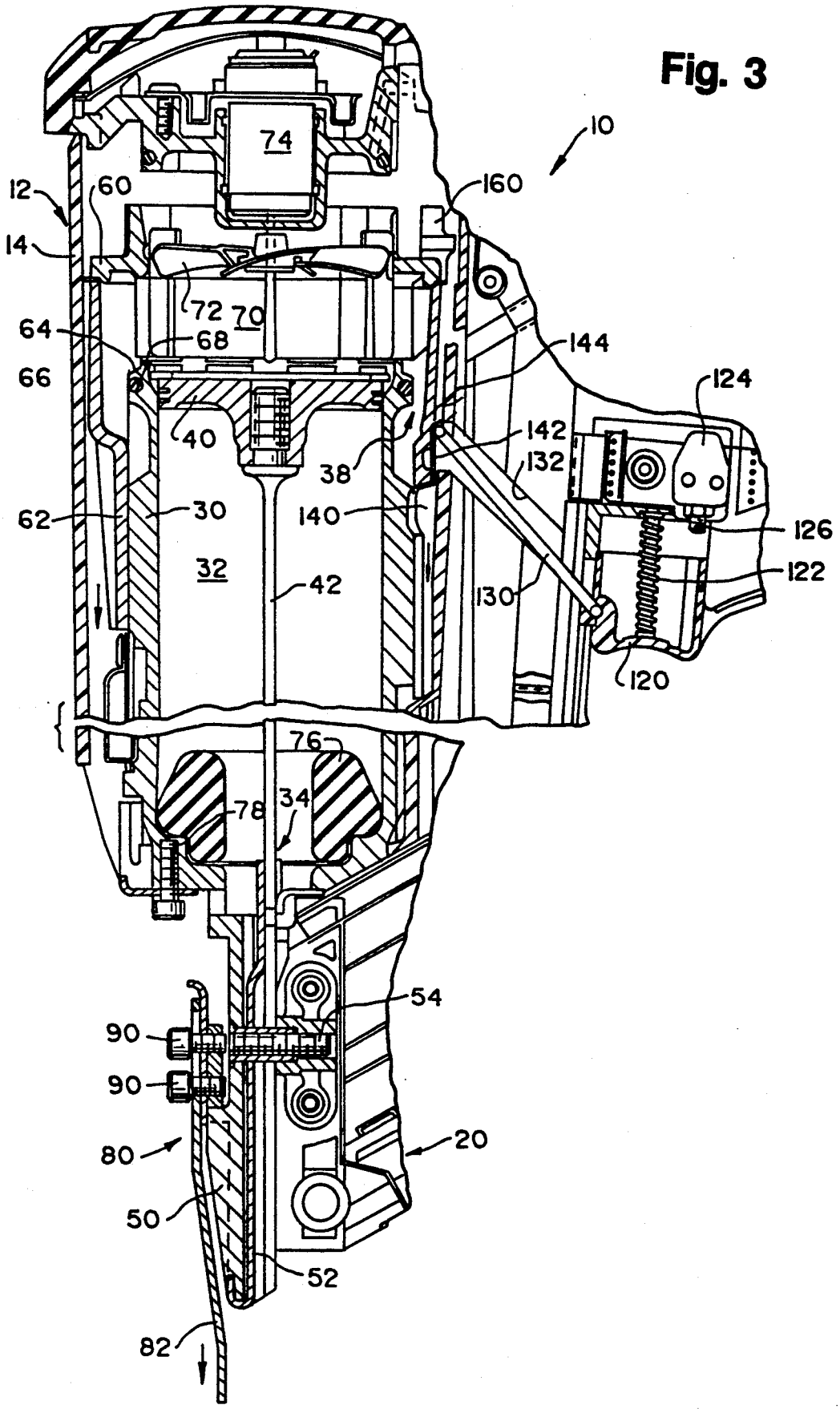
FIG. 3 is a view similar to FIG. 1, taken along the same plane, and showing the tool with the workpiece-contacting member extended, with the trigger deactuated, and with the piston in the upper position.
Figure 4:
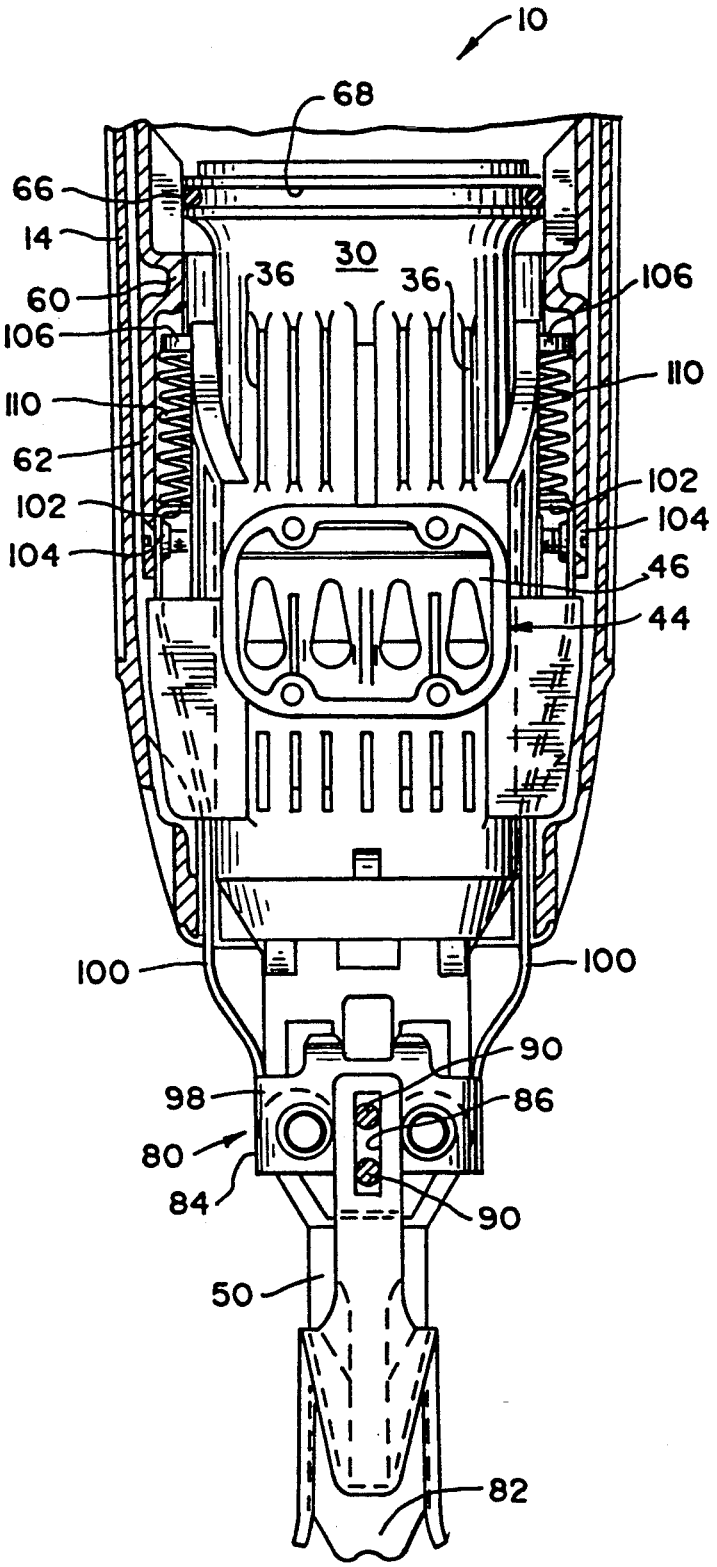
FIG. 4 is a view similar to FIG. 2, taken along the same plane, and showing the tool with the workpiece-contacting member extended. A cylinder body and related parts are shown in full elevation.

The tool 10 comprises a cylinder body 30 mounted fixedly within the housing structure 12. The cylinder body 30 has a piston chamber 32, which defines an axis, and a blade orifice 34. The cylinder body 30 has integral cooling fins 36 extending laterally from the cylinder body 30. The cylinder body 30 is open at its upper end, as shown, so as to define a gas inlet and outlet passage 38. A piston 40 is moveable axially within the piston chamber 32 between an upper position, in which the piston 40 is shown in FIGS. 1 and 3, and a lower position, in which the piston 40 is shown in FIG. 4. A driving blade 42 is attached to the piston 40 so as to extend axially from the piston 40 and so as to be axially and conjointly moveable with the piston 40. The driving blade 42 is arranged to be forcibly and rapidly driven downwardly from the upper position, in a manner to be later described, so as to drive a nail, such as the nail N shown in FIG. 1, from the tool 10 into a workpiece W. As shown in FIG. 4, a muffler 44, which included a reed valve 46, is mounted to one side of the cylinder body 30.

The tool 10 includes a nosepiece 50 extending below the housing structure 12. A wear plate 52 is mounted fixedly to the nosepiece 50 via screws 54 (one shown in FIGS. 1 and 3) which also function to mount the nail-feeding mechanism 20 to the nosepiece 50. The nail-feeding mechanism 20 is mounted elsewhere to the handle portion 16 of the housing structure 12. The nosepiece 50 functions for receiving a nail from the nail-feeding mechanism 20, before the nail is engaged by the driving blade 42, and for guiding the nail as the nail is driven by the driving blade 42.

Advantageously, the cylinder body 30 and the nosepiece 50 are made in a single piece, which may be a steel casting that can be suitably machined so as to interfit with other components of the tool 10. The wear plate 52, which may be a steel stamping, prevents the nosepiece 50, as a portion of a cast piece, from wearing excessively as nails are driven by the driving blade 42.

The tool 10 includes a valve member 60 disposed within the housing structure 12 so as to be axially moveable between an upper position, in which the valve member 60 is shown in FIGS. 1 and 4, and a lower position, in which the valve member 60 is shown in FIG. 3. The valve member 60 has a sleeve portion 62, which is disposed around an upper portion 64 of the cylinder body 30 in the upper position of the valve member 60, as shown in FIGS. 1 and 4. An O-ring 66 is seated in an annular recess 68 in the upper portion 64 of the cylinder body 30. The O-ring 66 forms a generally gas-tight seal between the upper portion 64 of the cylinder body 30 and the sleeve portion 62 of the valve member 60, so as to close the gas inlet and outlet passage 38, when the valve member 60 is moved from its lower position into its upper position, which may be thus regarded as its combustion chamber-closing position. The valve member 60 moves away from the O-ring 66 so as to open the gas inlet and outlet passage 38 and the combustion chamber 70 when the valve member 60 is moved from its upper position into its lower position, which may be thus regarded as its combustion chamber-opening position.

The valve member 60 and the cylinder body 30 define a combustion chamber 70. A fan 72, which is driven by a battery-powered, electric motor 74, is mounted operatively in the combustion chamber 70. When the gas inlet and outlet passage 38 is closed, the combustion chamber 70 is closed. When the gas inlet and outlet passage 38 is opened, the combustion chamber 70 is opened.

An annular, elastomeric bumper 76 is disposed within the piston chamber 32, on an annular ledge 78, below the piston 40. The bumper 76 functions, in a known manner, to arrest downward movement of the piston 40 and the driving blade 42 and to absorb resultant shocks.

Figure 2:
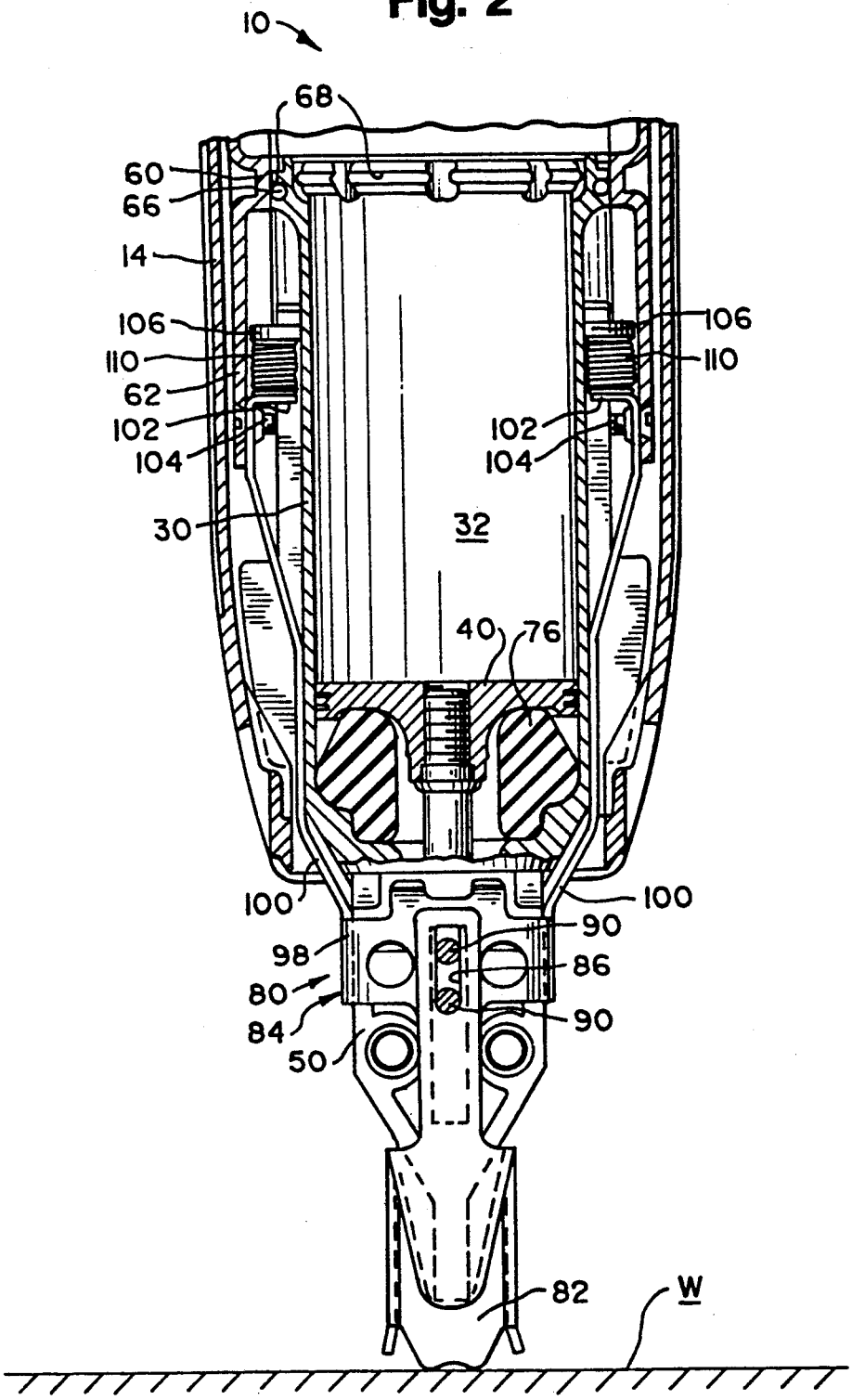

The tool 10 includes a linkage 80 for engaging the workpiece and for moving the valve member 60. The linkage 80 includes a workpiece-contacting element 82 and a valve sleeve-actuating element 84. The workpiece-contacting element 82 is mounted movably to the nosepiece 50 so as to permit the workpiece-contacting element 82 to move between an extended position, in which the workpiece-contacting element 82 is shown in FIGS. 1 and 4 and a displaced position, in which the workpiece-contacting element 82 is shown in FIGS. 2 and 3. The valve sleeve-actuating element 84 is connected to the workpiece-contacting element 82 so as to be conjointly moveable with the workpiece-contacting element 82. The workpiece-contacting element 82 has an elongate, axially extending slot 86, and the valve sleeve-actuating element 84 has two small apertures 88 behind the slot 86. Two screws 90 are passed through the slot 86, and through the respective apertures 88, and are threaded into two respective, threaded sockets 92 in a block 94 behind the valve sleeve-actuating element 84 so as to connect the workpiece-contacting element 82 adjustably to the valve sleeve-actuating element 84. Thus, the slot 86 permits a limited range of adjustments, which permit the tool 10 to be used to drive nails of a given length into a workpiece at any selected depth within a similar range of depths.

Figure 5:
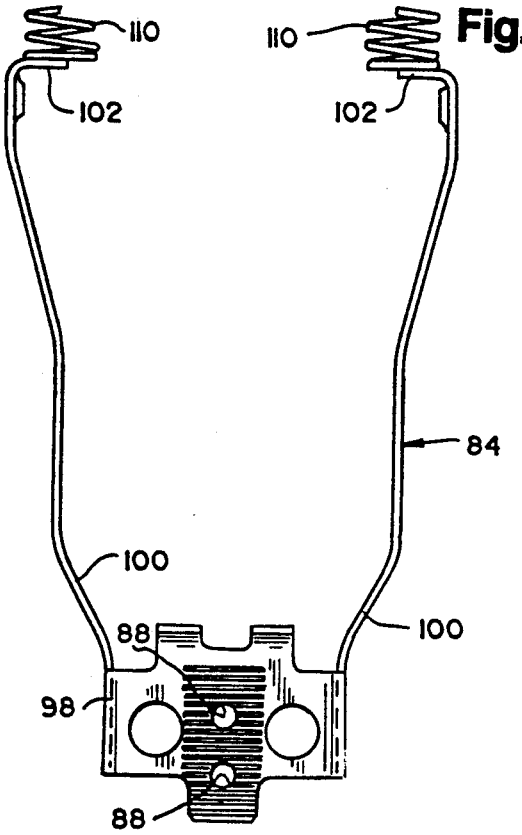
FIG. 5 is an enlarged, front elevation of the workpiece-contacting member, along with two biasing springs shown fragmentarily.
Figure 6:
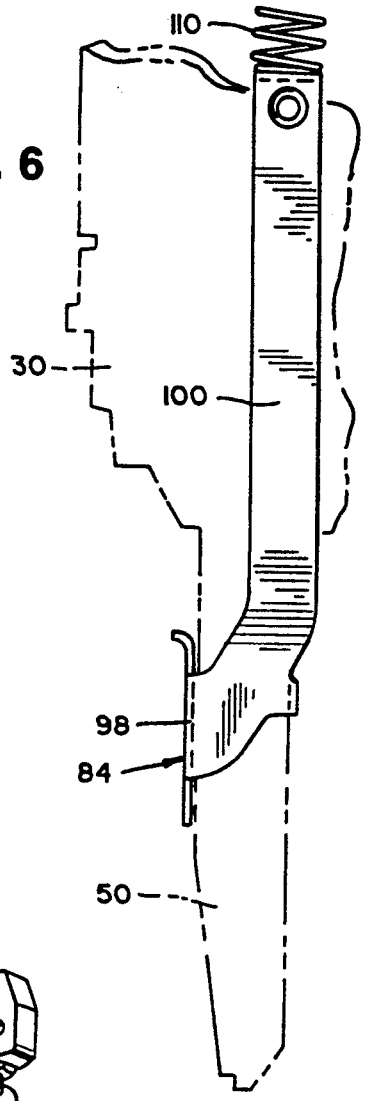
FIG. 6 is a similarly enlarged, side elevation of the workpiece-contacting member, along with the biasing springs shown fragmentarily. Portions of a cylinder body and a nosepiece, which are formed as a single piece, are shown in phantom lines.

As shown in greater detail in FIGS. 5 and 6, the valve sleeve-actuating element 84 has an element 98 disposed alongside the nosepiece 50 and is bifurcated so as to have two arms 100 interconnected by the element 98. The arms 100 are disposed alongside the cylinder body 30, on opposite sides of such body 30. Each arm 100 has an end flange 102, near which such arm 100 is connected to the sleeve portion 62 of the valve member 60 via a screw 104. The arms 100 are arranged to push the sleeve portion 62 so as to push the valve member 60 from the lower, combustion chamber-opening position into the upper, combustion chamber-closing position when the workpiece-contacting element 82 is pressed against the workpiece W.

As shown in FIGS. 2 and 4, the cylinder body 30 has two outer ears 106, one on each side of the cylinder body 30 above the respective end flanges 102 of the arms 100. Two coiled springs 110 are provided, each being compressed axially between one of the outer ears 106 and the end flange 102 of one of the arms 100, so as to bias the valve member 60 downwardly into the combustion chamber-opening position and so as to bias the workpiece-contacting element 82 and the valve sleeve-actuating element 84 downwardly into the extended position. The coiled springs 110 permit the workpiece-contacting element 82 and the valve sleeve-actuating element 84 to be conjointly moved from the extended position into the displaced position.

Unlike the prior art construction of FIGS. 8, 9, and 10, the valve-actuating element 84 of the invention is configured and disposed so as to operate outside the peripheral surfaces or envelope of the unitary cylinder body 30 and nosepiece 50 of the tool and thus not contribute to the length of the tool. More specifically, and as shown in FIGS. 2 and 6, the arms 100 and associated springs 110 are disposed outside the cylinder body 30 and the integral interconnecting portion 98 is disposed alongside the nosepiece 50. Moreover, it has been found that the simplicity of the element 84 contributed to the simplification of the tool in other respects including the novel single-piece casting of the body 30 and nosepiece 50.

Thus, as compared to prior combustion-powered tools having similar capabilities, the tool 10 can be notably lighter, notably shorter, and much less expensive to produce.

Figure 7:
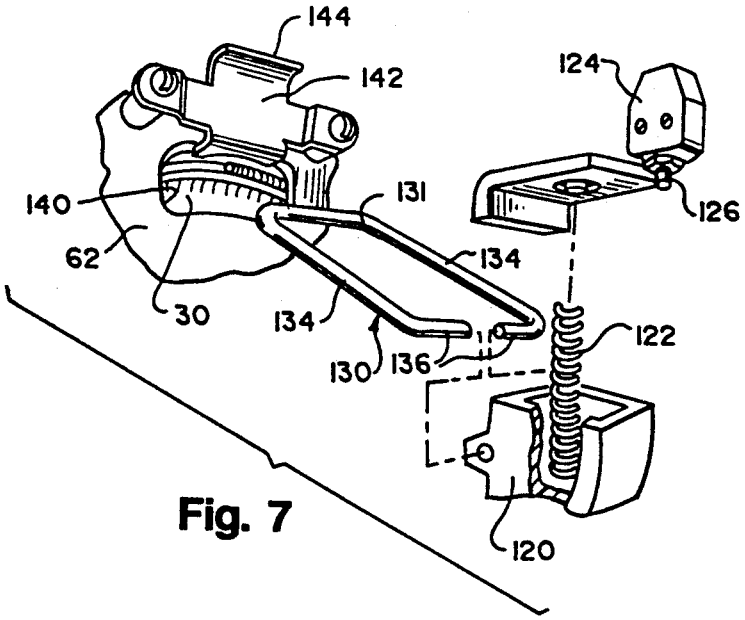
FIG. 7 is a similarly enlarged, fragmentary, exploded view of a trigger, a one-piece interlocking member, and related parts, as used in the tool.

As shown in FIGS. 1, 3, and 7, the tool 10 includes a manual trigger 120, which is mounted operatively to the housing structure 16. The trigger 120 is biased by a coiled spring 122 into an outer position, in which the trigger 120 is spaced from a normally opened, trigger switch 124 having an actuator 126 and (unless disabled in a manner described below) can be manually pulled from the outer position into an inner position, in which the trigger 120 actuates the trigger switch 124 via the actuator 126.

A pawl 130, which comprises a generally U-shaped wire, is mounted pivotally to the trigger 120. As shown in FIG. 7, the pawl 130 is formed to include a bight portion 131 from which extend two legs 134 having inwardly bent ends 136. The ends 136 are pivotally connected to the trigger 120 as shown assembled in FIGS. 1 and 3. The pawl 130 extends slidably and pivotally along opposed grooves 132 embossed in opposite sides of the handle portion 16, between the trigger 120 and the sleeve portion 62 of the valve member 60. The grooves 132 loosely receive the legs 134 and permit the pawl 130 to pivot and to be forwardly pushed when the trigger 120 is pulled inwardly by a user and permit the pawl 130 to pivot and to be backwardly pulled when the trigger 120 is pushed outwardly by the spring 122.

The sleeve portion 62 of the valve member 60 has a pawl-admitting aperture 140, which is disposed to admit the pawl 130 if the trigger 120 is pulled inwardly when the valve member 60 is in the combustion chamber-closing position, as shown in FIG. 1. The cylinder body 30 provides sufficient clearance for the pawl 130 between the upper portion 62 and the cooling fins 36. As best shown in FIG. 7, a wear plate 142 having an upper lip 144 is affixed to the sleeve portion 62 so as to cover an upper margin of the aperture 140 and so as to cover an outer area above the aperture 140. The aperture 140 is disposed so that if an attempt is made to pull the trigger 120 inwardly when the valve member 60 is in the combustion chamber-opening position, the bight 131 of the pawl 130 cannot enter the aperture 140 but engages the wear plate 142 at the lip 144, which arrests inward movement of the trigger 120 before the trigger 120 can actuate the trigger switch 124.

As shown in FIG. 1, the tool 10 includes a normally opened head switch 150 having an actuator 152. The head switch 150 is arranged to be closed via a flexible member 154 when the valve member 60 is moved into the combustion chamber-closing position. The member 154 is mounted within the housing structure 12 via a pin 156, so as to fix a lower end of the member 154, and tends to be normally disposed in a position wherein the member 154 is spaced from the actuator 152. The member 154 is provided at an upper end with a roller 158. The valve member 60 has an upper ear 160 disposed to engage the roller 158, so as to flex the member 154 backwardly to a position where the member 154 depresses the actuator 152, when the valve member 60 is moved into the combustion chamber-closing position. The trigger switch 124 and the head switch 150 are components of an ignition system of the tool 10.

Details of the head and trigger switches and of the ignition system are found in two copending patent applications assigned commonly herewith, namely one filed Jun. 17, 1991, under U.S. Ser. No. 07/716,215 for PHOTOELECTRIC SWITCH SEALED AGAINST INFILTRATION OF CONTAMINANTS, and another filed Dec. 9, 1991, under U.S. Ser. No. 07/797,355, for IMPROVED IGNITION SYSTEM FOR COMBUSTION-POWERED TOOL.

After the fan 72 has been actuated, and after the workpiece-contacting element 82 has been pressed against a workpiece so that the valve member 60 is moved from its combustion chamber-opening position into its combustion chamber-closing position and so that the head switch 150 is closed, the trigger 120 may be then pulled so as to initiate combustion of a fuel-air mixture in the combustion chamber 32, whereby the piston 40 is driven forcibly from its retracted position so that the driving blade 42 can drive a nail from the nosepiece 50 into a workpiece.

As described above, this invention provides a simple, compact, lightweight tool, which offers significant advantages over combustion-powered, fastener-driving tools known heretofore.

Various modifications may be made in the tool described above without departing from the scope and spirit of this invention which is defined by means of the appended claims. It is therefore to be understood that within the scope of the appended claims, the present invention may be practiced then as specifically described herein.

I claim:

1. A combustion-powered tool for driving fasteners, comprising:

a housing;

a cylinder body disposed within said housing and having a gas inlet and outlet passage, and defining a longitudinal axis of said tool;

a nosepiece disposed externally of said housing;

a valve sleeve movably disposed around said cylinder body and within said housing for opening and closing said gas passage; and a valve sleeve-actuating mechanism comprising a collar movably mounted on said nosepiece, and a pair of arms integrally connected at first end portions thereof to said collar and extending alongside said cylinder body so as to be directly connected at second opposite end portions thereof to said valve sleeve and thereby provide a simple, compact, lightweight tool.

2. The tool of claim 1 wherein the cylinder body and the nosepiece are formed integrally as a single component.

3. The tool of claim 1 further including two coiled springs, each being disposed between one of the arms and the cylinder body.

4. The tool of claim 3 wherein the cylinder body has two outer ears, each coiled spring being disposed between one of the arms and one of the outer ears.

5. A tool as set forth in claim 3, wherein:

said cylinder body has an axially extending outer peripheral surface; and said coiled spring are disposed adjacent to portions of said outer peripheral surface of said cylinder body.

6. A tool as set forth in claim 5, wherein:

said coiled spring are disposed upon diametrically opposite side portions of said outer peripheral surface of said cylinder body.

7. A powered tool for driving fasteners, comprising:

a housing;

a cylinder body disposed within said housing and having a gas inlet and outlet passage, and defining a longitudinal axis of said tool;

a nosepiece disposed externally of said housing;

a valve member movably disposed upon said cylinder body and within said housing for opening and closing said gas passage; and a valve member-actuating mechanism comprising a collar movably mounted on said nosepiece, and at least one arm integrally connected at a first end portion thereof to said collar and extending alongside said cylinder body so as to be directly connected at a second opposite end portion thereof to said valve member for conjoint movement with said valve member relative to said cylinder body and thereby provide a simple, compact, lightweight tool.

8. A tool as set forth in claim 7, wherein:

said cylinder body and said nosepiece are formed integrally as a single component.

9. A tool as set forth in claim 7, further comprising:

spring means, interposed between said at least one arm and said cylinder body, for biasing said at least one arm, and said valve member connected thereto, to an extended position with respect to said housing.

10. A tool as set forth in claim 9, further comprising:

ears fixedly mounted upon said cylinder body; and said spring means is interposed between said ears of said cylinder body and said at least one arm.

11. A tool as set forth in claim 9, wherein:

said cylinder body has an axially extending outer peripheral surface; and said spring means is disposed externally of and adjacent to said outer peripheral surface of said cylinder body.

12. A combustion-powered tool for driving fasteners, comprising:

a combustion chamber;

a valve member movable along said combustion chamber between a chamber-opening position and a chamber-closing position, said valve member being arranged to open said combustion chamber when moved to said chamber-opening position and to close said combustion chamber when moved to said chamber-closing position;

a trigger actuatable to initiate combustion within said combustion chamber;

an aperture defined within said valve member; and a one-piece interlocking member connected at one end thereof to said trigger and having a second opposite end thereof movably engaged with said valve member such that when said valve member is disposed at said chamber-closing position, said second end of said interlocking member will be disposed within said aperture of said valve member so as to permit actuation of said trigger, while when said valve member is disposed at said chamber-opening position, said second end of said interlocking member will be engaged with a non-apertured portion of said valve member so as to prevent actuation of said trigger.

13. The tool of claim 12 further comprising a housing structure, within which the cylinder body is mounted fixedly and to which the trigger is mounted operatively, the housing structure comprising means for guiding the interlocking member so as to enable the interlocking member to be moved inwardly into the aperture, with a rocking motion, when the trigger is actuated with the valve member in the chamber-closing position.

14. The tool of claim 13 wherein said guiding means includes two spaced elements extending fixedly from the housing structure and wherein the interlocking member is formed from a single piece of metal wire having two leg portions and a bight portion, the leg portions being attached pivotally to the trigger and extending loosely between the spaced elements of the guiding means, the bight portion being movable inwardly into the aperture when the trigger is actuated with the valve member in the chamber-closing position.

15. A tool as set forth in claim 14, wherein:

said spaced elements comprise laterally spaced guide grooves.

16. A tool as set forth in claim 12, wherein:

said valve member comprises a cylindrical valve sleeve; and said aperture means is defined within a sidewall portion of said cylindrical valve sleeve.

17. A tool as set forth in claim 12, wherein:

said non-apertured portion of said valve member comprises a wear plate fixedly attached to said valve member and including a lip portion for engaging said interlocking member so as to prevent actuation of said trigger.

* * * * *